US005501013A

United States Patent [19]

Misera et al.

[11] Patent Number: 5,501,013

[45] Date of Patent: Mar. 26, 1996

[54] SPACER AND SPACER FRAME FOR AN INSULATING GLAZING UNIT AND METHOD OF MAKING SAME

[75] Inventors: Stephen C. Misera, Tarentum; Thomas P. Kerr, Pittsburgh; William R. Siskos, Delmont, all of Pa.

[73] Assignee: PPG Industries, Inc., Pittsburgh, Pa.

[21] Appl. No.: 254,222

[22] Filed: Jun. 6, 1994

Related U.S. Application Data

[62] Division of Ser. No. 64,264, May 20, 1993, Pat. No. 5,351,451, which is a division of Ser. No. 906,645, Jun. 30, 1992, Pat. No. 5,255,481, which is a division of Ser. No. 578,697, Sep. 4, 1990, Pat. No. 5,177,916.

[51] Int. Cl.[6] ..... B21D 1/00

[52] U.S. Cl. ..... 29/897.312; 29/527.4; 52/172; 52/658; 52/745.19; 52/745.15; 52/786.13

[58] Field of Search ..... 52/171, 172, 232, 52/398, 399, 400, 790, 658, 746, 745.19, 741.15; 29/897.312, 527.4

[56] References Cited

U.S. PATENT DOCUMENTS

| | | |
|---|---|---|
| 2,086,225 | 7/1937 | Hiering . |
| 2,097,927 | 11/1937 | Klemp . |
| 2,708,774 | 5/1955 | Seelen . |
| 2,974,377 | 3/1961 | Kunkle . |
| 3,105,274 | 10/1963 | Armstrong . |
| 3,280,523 | 10/1966 | Stroud et al. . |
| 3,283,890 | 11/1966 | Morris et al. . |
| 3,427,366 | 2/1969 | Verdol et al. . |
| 3,445,436 | 5/1969 | Lake et al. . |
| 3,478,483 | 11/1969 | Baker . |
| 3,657,900 | 4/1972 | Bowser et al. . |
| 3,674,743 | 7/1972 | Verdol et al. . |
| 3,768,223 | 10/1973 | Kurz . |
| 3,775,914 | 12/1973 | Patil . |
| 3,867,107 | 2/1975 | Long et al. . |
| 3,919,023 | 11/1975 | Bowser et al. . |
| 3,923,748 | 12/1975 | Hutt et al. . |
| 4,015,394 | 4/1977 | Kessler . |
| 4,057,945 | 11/1977 | Kessler . |
| 4,063,002 | 12/1977 | Wilson, Jr. . |
| 4,069,630 | 1/1978 | Chess et al. . |
| 4,109,431 | 8/1978 | Mazzoni et al. . |
| 4,153,594 | 5/1979 | Wilson, Jr. . |
| 4,222,213 | 9/1980 | Kessler . |
| 4,269,255 | 5/1981 | Nailor et al. . |
| 4,270,688 | 6/1981 | Janssens et al. . |
| 4,431,691 | 2/1984 | Greenlee . |
| 4,574,553 | 3/1986 | Lisec . |
| 4,590,240 | 5/1986 | Streeter et al. . |
| 4,780,521 | 10/1988 | Duck et al. . |
| 4,807,419 | 2/1989 | Hodek et al. . |

(List continued on next page.)

FOREIGN PATENT DOCUMENTS

| | | |
|---|---|---|
| 0403058 | 12/1990 | European Pat. Off. . |
| 639955 | 7/1950 | United Kingdom . |
| 898981 | 6/1962 | United Kingdom . |
| 1509178 | 4/1978 | United Kingdom . |
| 1585544 | 3/1981 | United Kingdom . |

OTHER PUBLICATIONS

Advertisement from Lockformer Company (no date).

"IBM Technical Disclosure Bulletin" vol. 11, No. 2, Jul. 1968.

"Super Spacer™", Edgetech I.G. Ltd.

Glover et al.; "Super Spacer™ Technical Report", Edgetech I. G. Ltd., May 1988.

"Introducing Super Spacer™ PIB".

Wright et al., "Thermal Resistance Measurement of Glazing System Edge–Seals and Seal Materials Using a Guarded Heater Plate Apparatus".

*Primary Examiner*—Wynn E. Wood

*Attorney, Agent, or Firm*—Donald C. Lepiane

[57] ABSTRACT

A substrate having a bead of a moisture and/or gas pervious adhesive having a desiccant therein is shaped to provide U-shaped spacer stock. The spacer stock is bent to provide a spacer frame having continuous corners.

44 Claims, 3 Drawing Sheets

U.S. PATENT DOCUMENTS 4,807,439 2/1989 Hain et al. .
4,808,452 2/1989 McShane .
4,817,354 4/1989 Bayer .
4,831,799 5/1989 Glover et al. .
4,850,175 7/1989 Berdan .
4,873,803 10/1989 Rundo .
4,933,032 6/1990 Kunert .

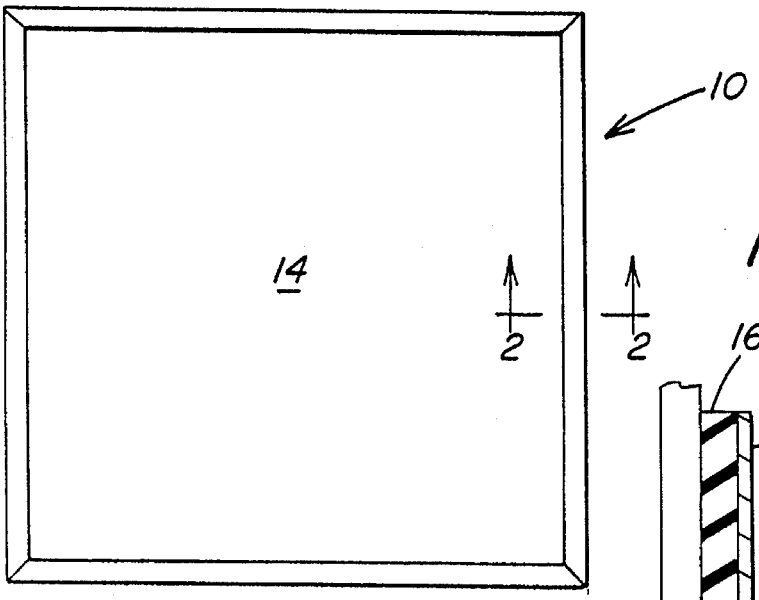
FIG. 1
FIG. 2
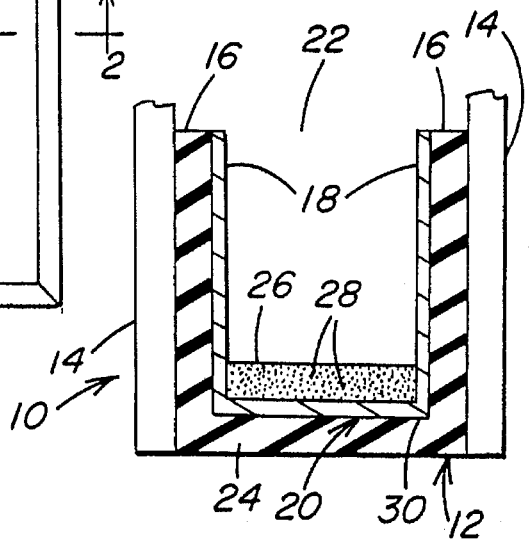
FIG. 3
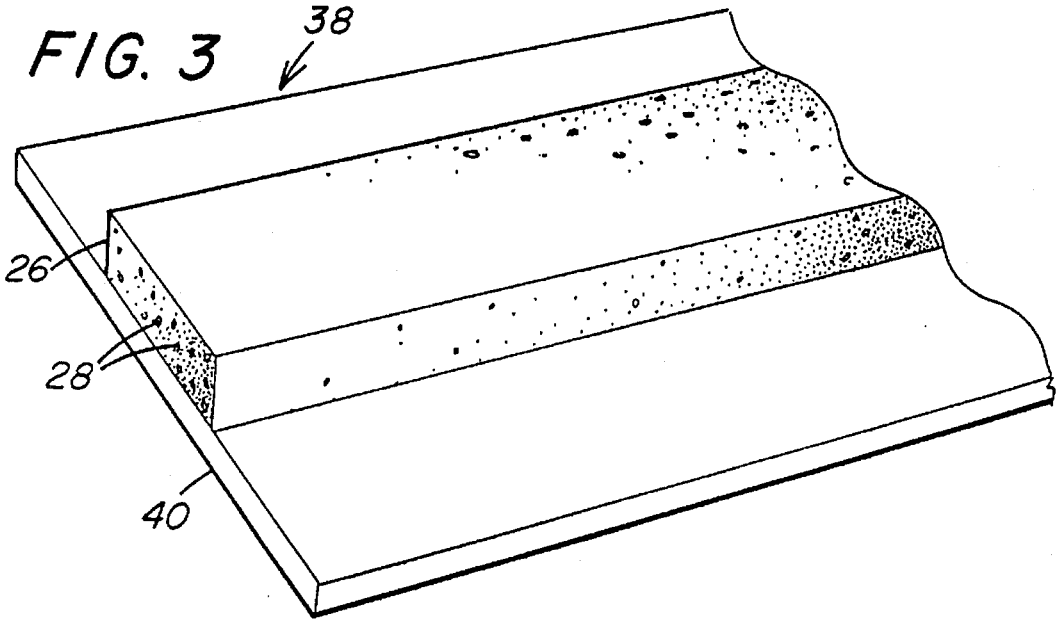

SPACER AND SPACER FRAME FOR AN INSULATING GLAZING UNIT AND METHOD OF MAKING SAME

RELATED APPLICATION

This is a divisional of application Ser. No. 08/064,264, filed May 20, 1993, now U.S. Pat. No. 5,351,451 which is a divisional of application Ser. No. 07/906,645 filed on Jun. 30, 1992, of Stephen C. Misera and William R. Siskos, now U.S. Pat. No. 5,255,481, which is a divisional of application Ser. No. 07/578,697 filed on Sep. 4, 1990, of William R. Siskos, now U.S. Pat. No. 5,177,916.

The spacer and spacer frame taught in this application may be used in the fabrication of the insulating unit taught in U.S. patent application Ser. No. 07/578,697 filed even date in the names of Stephen C. Misera and William R. Siskos and entitled INSULATING GLAZING UNIT HAVING A LOW THERMAL CONDUCTING EDGE AND METHOD OF MAKING SAME.

BACKGROUND OF THE INVENTION

1. Field of the Invention

This invention relates to components for an insulating glazing unit and to methods of making same and, in particular, to a spacer and spacer frame for an insulating glazing unit and methods of making same.

2. Discussion of the Technical Problems

It is well recognized that insulating glazing units reduce heat transfer between the outside and inside of a home or other structures. A measure of insulating value generally used is the "U-value". The U-value is the measure of heat in British Thermal Unit (BTU) passing through the unit per hour (Hr) per square foot (sq.ft.) per degree Fahrenheit (°F.). As can be appreciated the lower the U-value the better the thermal insulating value of the unit, i.e. higher resistance to heat flow resulting in less heat conducted through the unit. Another measure of insulating value is the "R-value" which is the inverse of the U-value. Still another measure is the resistance (RES) to heat flow which is stated in Hr-°F. per BTU per inch of perimeter of the unit. In the past the insulating property, e.g. U-value given for an insulating unit was the U-value measured at the center of the unit. Recently it has been recognized that the U-value of the edge of the unit must be considered separately to determine the overall thermal performance of the unit. For example, units that have a low center U-value and high edge U-value during the winter season exhibit no moisture condensation at the center of the unit, but may have condensation or even a thin line of ice at the edge of the unit near the frame. The condensation or ice at the edge of the unit indicates that there is heat loss through the edge of the unit and/or frame i.e. the edge has a high U-value.

Through the years, the design of and construction materials used to fabricate insulating glazing units, and the frames have improved to provide framed units having low U-values. Several types of insulating glazing units presently available, and or center and edge U-values of selected ones, are taught in U.S. patent application Ser. No. 07/468,039 assigned to PPG Industries, Inc. filed on Jan. 22, 1990, in the names of P. J. Kovacik et al. and entitled METHOD OF AND APPARATUS FOR JOINING EDGES OF GLASS SHEETS, ONE OF WHICH HAS AN ELECTROCONDUCTIVE COATING AND THE ARTICLE MADE THEREBY, and U.S. Pat. Nos. 3,919,023; 4,431,691; 4,807, 419; 4,831,799 and 4,873,803. The teachings of the patent application and patents are hereby incorporated by reference.

U.S. patent application Ser. No. 07/578,697 filed even date in the names of Stephen C. Misera and William R. Siskos and entitled INSULATING GLAZING UNIT HAVING A LOW THERMAL CONDUCTING EDGE AND METHOD OF MAKING SAME teaches the design of and methods of making an insulating unit having a low thermal conducting edge. In Section 2 *Discussion of Available Insulating Units*, the drawbacks and/or limitations of the insulating units of the above identified patent application and patents are discussed. The teachings of U.S. patent application Ser. No. 07/578,697 are hereby incorporated by reference.

As can be appreciated, it would be advantageous to provide a spacer and spacer frame, and method of making same that can be used to fabricate insulating units taught in U.S. patent application Ser. No. 07/578,697 as well as other types of insulating units.

SUMMARY OF THE INVENTION

This invention covers a strip for shaping into spacer stock for use in the fabrication of insulating units. The strip includes a metal substrate having a bead of moisture and/or gas pervious adhesive secured to a surface of the substrate. The metal substrate after forming into the spacer stock e.g. U-shaped spacer stock can withstand higher compressive forces than the bead.

The invention also covers a method of making U-shaped spacer stock for use in fabricating a spacer frame for insulating units. The method includes the steps of passing a metal substrate having a bead of moisture and/or gas pervious adhesive positioned on a surface between spaced pairs of roll forming wheels shaped to gradually bend the metal substrate about the bead into spacer stock having a predetermined cross sectional shape, e.g. U-shaped cross section.

Further, the invention covers a spacer frame for an insulating unit, the spacer frame having a groove to define opposed outer sides and having at least one continuous corner, and methods of making same. A method includes the steps of providing a section of spacer stock sufficient to make a frame of a predetermined size. Opposed surfaces of the spacer stock are biased inwardly while the spacer stock is bent about the depressions of the spacer stock to form a continuous corner. The step to form a continuous corner is repeated until the opposite ends are brought together and sealed e.g. by welding.

BRIEF DESCRIPTION OF THE DRAWINGS

FIG. 1 is a plan view of an insulating unit incorporating features of the invention.

FIG. 2 is a view taken along line 2—2 of FIG. 1.

FIG. 3 is a view of an edge strip incorporating features of the invention having secured thereto a bead of a moisture and/or gas pervious adhesive having a desiccant.

DESCRIPTION OF THE INVENTION

Figure 4:
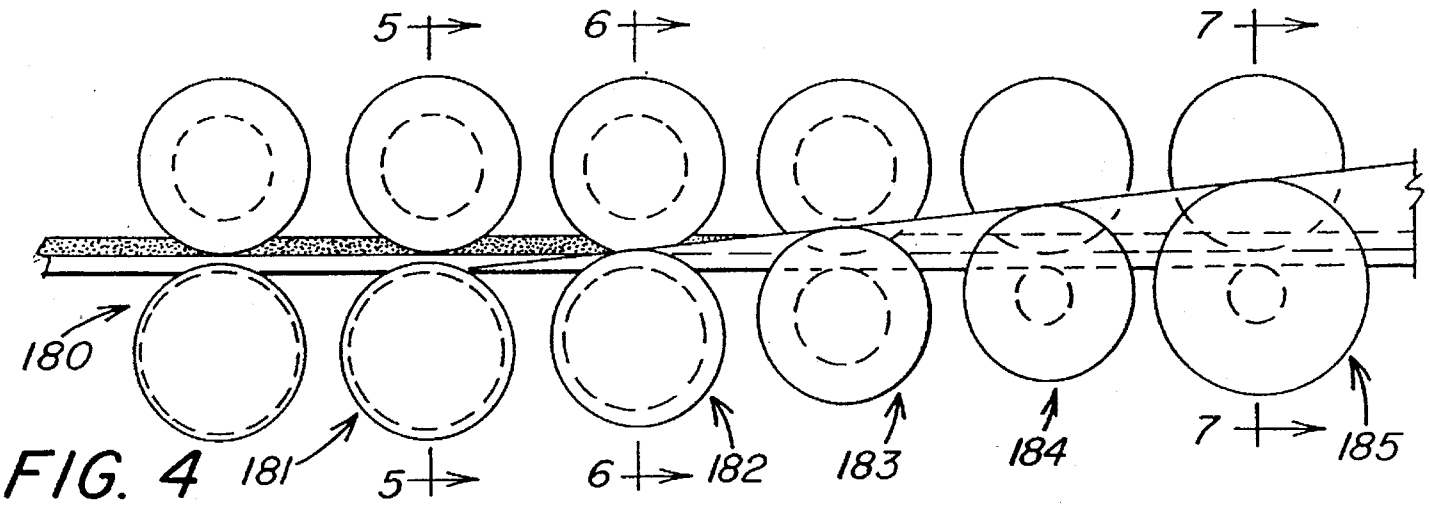
FIG. 4 is a side elevated view of a roll forming station to form the edge strip of FIG. 3 into spacer stock incorporating features of the instant invention.

The invention will be discussed in contemplation of fabricating the insulating unit taught in U.S. patent application Ser. No. 07/578,697 filed even date in the names of Stephen C. Misera and William R. Siskos and entitled INSULATING GLAZING UNIT HAVING A LOW THERMAL CONDUCTING EDGE AND METHOD OF MAKING SAME; however, as will be appreciated the instant invention is not limited thereto and may be practiced to fabricate any type of insulating unit using a spacer to maintain sheets in spaced relation. The teachings of U.S. patent application Ser. No. 07/578,697 are hereby incorporated by reference.

In the following discussion like numerals refer to like elements.

With reference to FIGS. 1 and 2 there is shown insulating unit 10 discussed in the above-identified application having edge assembly 12 (shown only in FIG. 2) incorporating features of the invention to space the sheets 14 e.g. coated and/or uncoated glass sheets. The edge assembly 12 includes moisture and gas impervious adhesive type sealant layers 16 adhere to the glass sheets 14 and outer legs 18 of metal spacer 20 to provide compartment 22 between the sheets. The sealant layers 16 act as a barrier to moisture entering the unit and/or a barrier to gas e.g. insulating gas such as Argon from exiting the compartment 22. An additional adhesive sealant type layer or structural adhesive layer 24 may be provided in perimeter groove of the unit formed by the spacer and marginal edges of the sheets 14. As can be appreciated the sealant is not limiting to the invention and may be any types known in the art e.g. of the type taught in U.S. Pat. No. 4,109,431 which teachings are hereby incorporated by reference.

A thin layer or bead 26 of a moisture and/or gas pervious adhesive having a desiccant 28 therein to absorb moisture in the compartment 22 is provided on the inner surface of middle leg 30 of the spacer 20 as viewed in FIG. 2. The adhesive is not limiting to the invention and may be any type that passes moisture and/or gas.

An insulating unit having the edge assembly 12 of the instant invention as shown in FIG. 2 included a pair of glass sheets 14 spaced about 0.47 inch (1.120 centimeters) apart; polyisobutylene layers 16 (moisture and argon impervious) having a thickness of about 0.010 inch (0.254 centimeter) and a height as viewed in FIG. 2 of about 0.25 inch (0.64 centimeter); a 304 stainless steel U-shaped channel 20 having a thickness of about 0.007 inch (0.018 centimeter), the middle or center leg 30 having a width as viewed in FIG. 2 of about 0.45 inch (1.14 centimeters) and outer legs 18 each having a height as viewed in FIG. 2 of about 0.25 inch (0.32 centimeter); a desiccant impregnated polyurethane bead 26 having a height of about 0.125 inch (0.032 centimeter) and a width as viewed in FIG. 2 of about 0.43 inch (1.09 centimeters); a polyisobutylene edge seal 24 having a height of about 0.125 inch (0.32 centimeter) and a width of about 0.47 inch (1.20 centimeters) as viewed in FIG. 2.

With reference to FIG. 3 there is shown an edge strip 38 having a substrate 40 having the bead 26. In the preferred practice of the invention the substrate is made of a material, e.g. metal, that is moisture and gas impervious to maintain the insulating gas in the compartment and prevent the ingress of moisture into the compartment, and has structural integrity to maintain the glass sheets 14 in spaced relation to one another. In the practice of the invention, the substrate was made of 304 stainless steel having a thickness of about 0.007 inch (0.0178 centimeter), a width of about 0.625 inch (1.588 centimeters) and a length sufficient to make a frame for an insulating unit of a predetermined shape and dimension e.g. a 24-inch (0.6 meter) square shaped unit. The bead 26 is any type of adhesive material that is moisture and gas pervious and can be mixed with a desiccant. In this manner the desiccant can be contained in the adhesive material and secured to the substrate while having communication to the compartment. Types of materials that are recommended, but not limiting to the invention include polyurethanes and/or silicones. In an embodiment of the invention a bead about ⅛ inch (0.32 centimeter) high and about 0.43 inch (1.09 centimeters) thick is applied to about the center of the substrate 40 in any convenient manner. In the practice of the invention the metal substrate after forming into spacer stock can withstand higher compressive forces than the bead. As can be appreciated by those skilled in the art, a metal substrate can be fabricated through a series of bends and shaped to withstand various compressive forces. The invention relating to the bead 26 carried on the substrate 40 is defined by shaping the substrate 40 into a single walled U-shaped spacer stock with the resultant U-shaped spacer stock being capable of withstanding values of compressive force greater than the bead secured or to be secured to the U-shaped spacer. In this manner the spacer and not the bead maintains the spacing between the sheets. Substrates and beads having the foregoing relationship are defined for purposes of defining this embodiment of the invention as substrates having more "structural stability" than the bead. As can be appreciated by those skilled in the art the measure and value of compressive forces and structural stability varies depending on the manner the unit is secured in position. For example if the unit is secured in position by clamping the edges of the unit such as in a curtainwall system, the spacer has to have sufficient strength to maintain the glass sheet apart while under compressive forces of the clamping action. When the unit is mounted in a rabbit of a wooden frame and caulking applied to seal the unit in place, the spacer does not have to have as much structural stability to maintain the glass sheets apart as does a spacer of a unit that is clamped in position.

The outer edges of the substrate 40 are bent to form outer legs 18 of the U-shaped spacer 30 shown in FIG. 2 in any convenient manner. For example the substrate 40 having the bead 26 may be shaped by moving it between bottom and top forming rolls shown in FIGS. 4–7.

Figure 5:
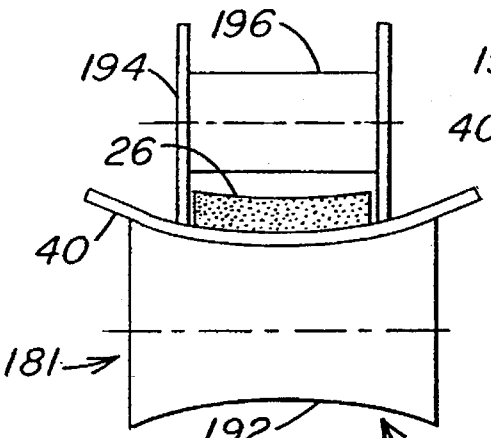

The substrate 40 having the bead 26 is advanced from left to right as viewed in FIG. 4 between roll forming stations 180 thru 185. As will be appreciated by those skilled in the art, the invention is not limited to the number of roll forming stations or the number of roll forming wheels at the roll forming stations. In FIG. 5 the roll forming station 181 includes a bottom wheel 190 having a peripheral groove 192 and an upper wheel 194 having a peripheral groove 196 sufficient to accommodate the bead 26. The groove 192 is sized to start the bending of the substrate 40 to a U-shaped spacer and is less pronounced than groove 198 of the bottom wheel 200 of the roll forming station 182 shown in FIG. 6 and the remaining bottom wheels of the downstream roll forming station 183 thru 185.

Figure 7:
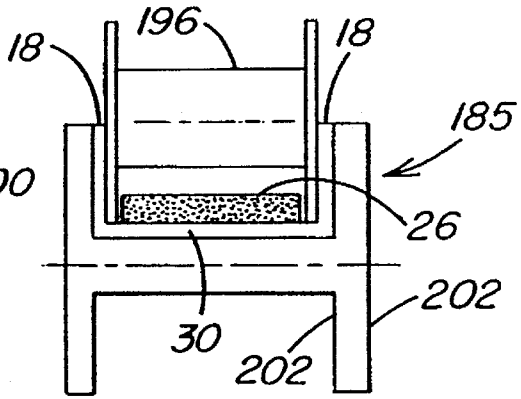
FIGS. 5 thru 7 are views taken along lines 5 thru 7 respectively of FIG. 4.
Figure 6:
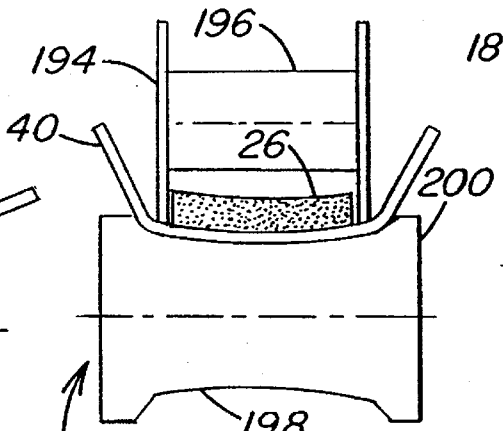

With reference to FIG. 7, the lower roll forming wheel 202 of the pressing station 185 has a peripheral groove 202 that is substantially U-shaped. The spacer stock exiting the roll forming station 185 is the U-shaped spacer 20 shown in FIG. 2.

As can now be appreciated the grooves of the upper wheels may be shaped to shape the bead as the spacer stock is formed.

In the practice of the invention the bead 26 was applied after the spacer stock was formed in a frame. The substrate 40 was pulled through a die of the type known in the art to form a flat strip into a U-shaped strip.

As can be appreciated, the invention is discussed making a U-shaped spacer; however, the invention is not limited thereto and may be used to make spacer stock having any cross sectional shape e.g. the cross sectional shape taught in U.S. Pat. No. 3,105,274 which teachings are hereby incorporated by reference.

An advantage of having the desiccant in the moisture and/or gas pervious bead 26 is ease of handling the desiccant, ease of securing it to the spacer stock and increased shelf life. The shelf life is increased because the desiccant takes a longer period of time to become saturated when in the moisture and/or gas pervious material as compared to being directly exposed to moisture. The length of time depends on the porosity of the moisture and/or gas pervious material.

Figure 8:
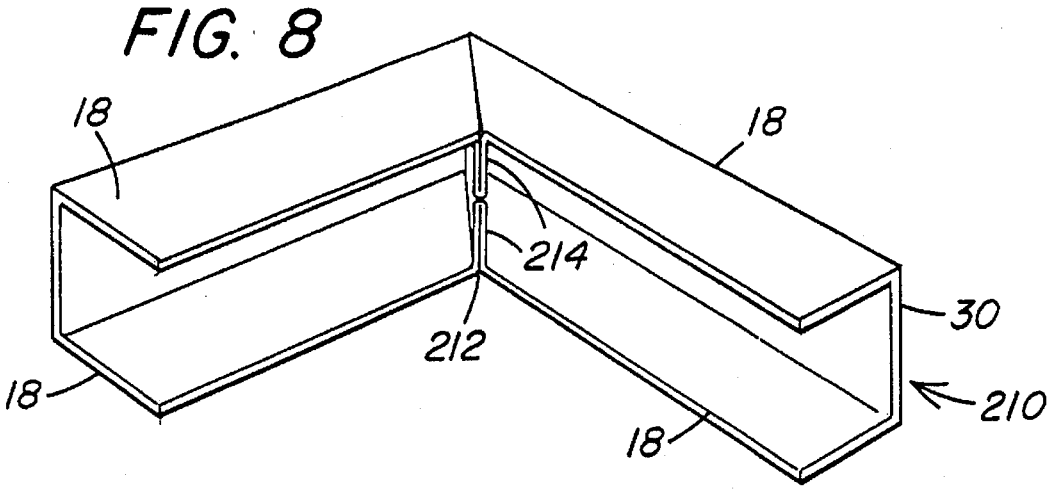
FIG. 8 is a view of a continuous corner of a spacer frame embodying features of the instant invention.
Figure 10:
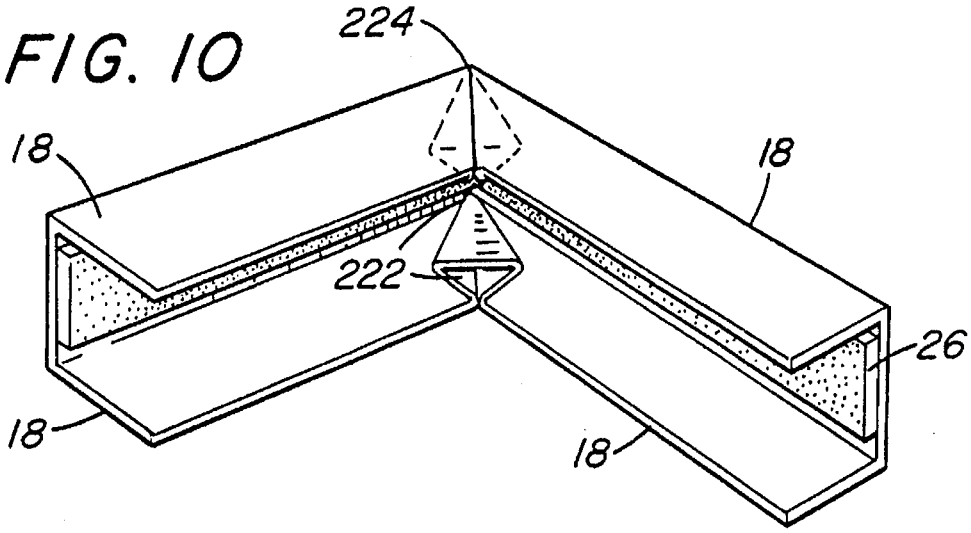
FIG. 10 is a view of another embodiment of a continuous corner of a spacer frame of the instant invention made using the spacer stock shown in FIG. 9.

The spacer stock may be formed into a spacer frame for positioning between sheets. As can be appreciated, the adhesive layers 16 and 24 and the bead 26, shown in FIG. 2 may be applied to the spacer stock or to the spacer frame. The invention is not limited to the materials used for the layers 16 and 24; however, as was discussed, it is recommended that the layers 16 provide high resistance to the flow of insulating gas and/or moisture. The layer 24 may be of the same material as layers 16 or a structural type adhesive e.g. silicone. Before or after the layers 16 and/or 24 are applied to the spacer stock, a piece of the spacer stock is cut and bent to form a spacer frame. Corners may be formed i.e. continuous corners and the free ends of spacer stock welded or sealed use a moisture and/or gas impervious sealant. Continuous corners of spacer frames incorporating features of the invention are shown in FIGS. 8 and 10. As can be appreciated, spacer frames may also be formed by joining sections of U-shaped spacer stock and sealing the edges with a moisture and/or gas impervious sealant or welding the corners together.

With reference to FIG. 8 in the practice of the invention, spacer frame 210 was formed from U-shaped spacer stock. A continuous corner 212 was formed by depressing the outer legs 18 of the spacer stock toward one another while bending portions of the spacer stock about the depression to form a corner e.g. 90° angle. As the portions of the spacer stock are bent the depressed portion 214 of the outer legs 18 move inwardly toward one another. The depressed portions 214 may if desired be offset from one another to accommodate the portions 214 within the outer leg 18. After the frame 210 is formed, layers of sealant 16 are provided on the outer surfaces of the legs 18 of the spacer frame and the bead 26 on the inner surface of the middle leg 30. The unit 10 was constructed by positioning and adhering glass sheets to the spacer frame by the sealant layers 16 in any convenient manner. Thereafter a layer 20 is provided in the peripheral channel of the unit (see FIG. 2) or on the periphery of the unit. Argon gas is moved into the compartment 18 in any convenient manner to provide an insulating unit having a low thermal conducting edge.

Figure 9:
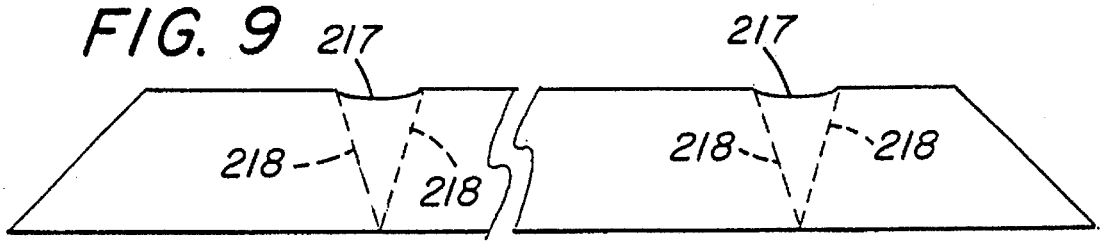
FIG. 9 is a partial side view of a section of spacer stock notched and creased prior to bending to form the continuous corner of the spacer frame shown in FIG. 10 in accordance to the teachings and incorporating features of the invention.

With reference to FIGS. 9 and 10 another technique to form a spacer frame having continuous corners is discussed. A length of the spacer stock having the bead 26 is cut and a notch 217 and creases 218 are provided in the spacer stock at the expected bead lines in any convenient manner. The area between the creases 218 is depressed and portion 222 of the outer legs 156 at the notch are bent inwardly while the portions on each side of bend point are biased toward each other to provide a continuous overlying corner 224 as shown in FIG. 10. The non-continuous corner e.g. the fourth corner of a rectangular frame may be sealed with a moisture and/or gas impervious material or welded. As can be appreciated the bead at the corners may be removed before forming the continuous corners.

As can be appreciated by those skilled in the art, the invention is not limited by the above discussion which was presented for illustrative purposes only and may be used to fabricate any type of insulating unit that has a metal spacer.

What is claimed is:

1. A method of making a spacer frame for spacing sheets of a multi sheet glazing unit, the spacer frame having at least one corner, comprising the steps of:

providing an elongated substrate of a bendable material, the substrate having a first edge and a second edge spaced from and opposite to the first edge, a first major surface and a second major surface opposite to the first major surface between the first and second edges;

imposing on a major surface of the substrate a first set of crease lines adjacent the first edge and spaced from centerline of the substrate and a second set of crease lines adjacent the second edge and spaced from the centerline with the first set of crease lines opposite the second set of crease lines, the first and second sets of crease lines each include at least two bend lines, the bend lines of the first set of crease lines angled toward one another to provide a generally "V" shape configuration with the open end of the "V" facing the first edge of the substrate and the bend lines of the second set of crease lines angled toward one another to provide a generally "V" shape configuration with the open end of the "V" formed by the second set of crease lines facing the second edge of the substrate;

forming the substrate to provide a spacer stock having a first upright leg and a second upright leg spaced from the first upright leg with the first and second upright legs connected by a base to provide the upright legs and the base with a generally U-shaped cross section configuration with the first major surface of the substrate defining inner surface of the spacer stock and with the "V" formed by the first set of crease lines in the first upright leg and the "V" formed by the second set of crease lines in the second upright leg;

bending the base of the spacer stock at a location between the first and second sets of crease lines while moving portions of the first and second upright legs between the "V" formed by the first and second set of crease lines toward each other over the base to provide the spacer frame having the at least one corner, and joining ends of the spacer frame, wherein the first upright leg of the spacer frame lies in a first plane, the second upright leg of the spacer frame lies in a second plane, the base of the spacer frame on one side of the at least one corner lies in a third plane, and the base of the spacer frame on the other side of the at least one corner lies in a fourth plane with the first and second planes parallel to one another, the third and fourth planes intersecting one another and the third and fourth planes intersecting the first and second planes, and the base of the spacer frame and portions of the upright legs of the spacer frame at the at least one corner being continuous.

2. The method as set forth in claim 1 including the step of providing a bead of moisture and gas pervious material having a desiccant on selected portions of the inner surface of the spacer stock.

3. The method as set forth in claim 1 including the step of removing a portion of the first and second edges of the substrate to provide a notch between the bend lines of the first and second sets of crease lines, respectively.

4. The method as set forth in claim 3 wherein the removing a portion step is practiced prior to the practice of said forming step.

5. The method as set forth in claim 1 wherein the substrate is a metal substrate.

6. The method as set forth in claim 2 wherein the bead is on the inner surface of the base between the first and second upright legs of the spacer stock.

7. The method as set forth in claim 1 wherein the forming step includes passing the substrate through roll forming wheels which progressively shape the substrate into the spacer stock.

8. The method as set forth in claim 7 wherein the substrate is a metal substrate and further including the step of providing a bead of a moisture and gas pervious material having a desiccant on a center portion of the first major surface of the substrate and wherein said passing step includes:

providing a plurality of roll forming wheels having bottom wheels shaped to gradually form the metal substrate into the spacer stock and an upper roll for each forming wheel, the upper rolls each having a peripheral groove to provide the bead with a predetermined shape.

9. The method as set forth in claim 1 where the height of each of the upright legs of the spacer stock is greater than one-half the distance of the base of the spacer stock between the upright legs, and said bending step includes offsetting the portions of the upright legs extending over the base.

10. The method as set forth in claim 2 wherein the step of providing a bead of a moisture and gas pervious material having a desiccant is practiced before the bending step.

11. The method as set forth in claim 1 wherein the second major surface of the substrate is an outer surface of the spacer stock and further including the step of providing a moisture and gas impervious sealant on selected outer surfaces of the spacer stock.

12. The method as set forth in claim 1 wherein said imposing step includes removing a portion of the first and second edge of the substrate to provide a notch between the bend lines of each of the first and second sets of crease lines, respectively.

13. The method as set forth in claim 12 further including the step of applying a moisture pervious adhesive having a desiccant therein on selected portions of the inner surface of the spacer stock.

14. The method as set forth in claim 13 wherein the second major surface of the substrate is an outer surface of the spacer stock and after the practice of the forming step providing a layer of a moisture impervious material on selected portions of the outer surface of the spacer stock.

15. The method as set forth in claim 14 wherein the spacer frame is made of metal and includes four corners and three of the four corners are formed by repeating the imposing and bending steps.

16. A method of making a spacer stock for use in making a spacer frame for spacing sheets of a multi sheet glazing unit, comprising the steps of:

providing an elongated substrate of a bendable material, the substrate having a first edge and a second edge spaced from and opposite to the first edge, a first major surface and a second major surface opposite to the first major surface between the first and second edges;

imposing on a major surface of the substrate a first set of crease lines adjacent the first edge and spaced from centerline of the substrate and a second set of crease lines adjacent the second edge and spaced from the centerline with the first set of crease lines opposite the second set of crease lines, the first and second sets of crease lines each include at least two bend lines imposed in one of the major surfaces of the substrate, the bend lines of the first set of crease lines angled toward one another to provide a generally "V" shape configuration with the open end of the "V" facing the first edge, and the bend lines of the second set of crease lines angled toward one another to provide a generally "V" shape configuration with the open end of the "V" of the second set of crease lines facing the second edge, and forming the substrate to provide a spacer stock having a first upright leg and a second upright leg spaced from the first upright leg and connected by a base to provide the upright legs and base with a generally U-shaped cross section configuration with the first major surface of the substrate defining an inner surface of the spacer stock and with the first set of crease lines in the first upright leg and the second set of crease lines in the second upright leg and with the base being continuous.

17. The method of claim 16 wherein prior to the practice of the forming step providing a moisture and gas pervious material having a desiccant on selected portions of the first major surface of the substrate.

18. The method of claim 16 wherein after the practice of the forming step providing a moisture and gas pervious material having a desiccant on selected portions of the inner surface of the spacer stock.

19. The method of claim 16 including the step of removing a portion of the first and second edges of the substrate to provide a notch between the bend lines of each of the first and second set of crease lines.

20. The method of claim 19 further includes the step of providing a bead of a moisture and gas pervious material on inner surface of the base of the spacer stock.

21. The method of claim 20 when the step of providing a bead is practiced after the forming step.

22. A method of making a spacer stock for use in making a spacer frame for spacing sheets of a multi sheet glazing unit, comprising the steps of:

providing an elongated substrate having a predetermined length, the substrate having a first edge and a second edge spaced from the first edge, a base segment of the substrate between and spaced from the edges defining a base segment of the substrate, a segment of the substrate between the first edge and the base segment defining a first outer segment of the substrate and a segment of the substrate between the second edge and the base segment defining a second outer segment of the substrate with the second outer segment of the substrate spaced from and opposite to the first outer segment of the substrate;

removing a portion of the first outer segment of the substrate defined as a deleted portion of the first outer segment such that a portion defined as a remaining portion of the first outer segment remains and interconnects portions of the first outer segment on each side of the deleted portion of the first outer segment, and a portion of the second outer segment of the substrate defined as deleted portion of the second outer segment such that portion defined as a remaining portion of the second outer segment remains and interconnects portions of the second outer segment on each side of the deleted portions of the second outer segment wherein the deleted portions of the first and second outer segments are spaced from and opposite to one another, and forming the substrate to provide the spacer stock, the spacer stock having a base provided by the base segment of the substrate, and a first upright leg provided by portions of the first outer segment and a second upright leg provided by portions of the second outer segment, with the first and second edges of the substrate spaced from one another, wherein the deleted portion of the first outer segment is in the first upright leg of the spacer stock and the deleted portion of the second outer segment is in the second upright leg of the spacer, the base is continuous and the predetermined length is sufficient to make the spacer frame having a continuous base.

23. The method as set forth in claim 1 wherein the second major surface of the substrate is outer surface of the spacer frame and further including the step of providing a moisture and gas impervious sealant on selected portions of the outer surface of the spacer stock.

24. A method of making a spacer frame for spacing sheets of a multi sheet glazing unit, the frame having at least one corner, a base and first and second upright legs joined to the base, the upright legs providing the spacer frame with surfaces to which the sheets of the unit are secured, comprising the steps of:

providing an elongated substrate of sufficient length to make the spacer frame, the substrate having a first edge and a second edge spaced from and opposite the first edge, a center segment of the substrate between and spaced from the edges defining a base segment of the substrate, a segment of the substrate between the first edge and the base segment defining a first outer segment of the substrate, and a segment of the substrate between the second edge and the base segment defining a second outer segment of the substrate with the second outer segment of the substrate spaced from and opposite to the first outer segment of the substrate;

removing a portion of the first outer segment of the substrate defined as a deleted portion of the first outer segment such that a portion defined as a remaining portion of the first outer segment remains to interconnect portions of the first outer segment on each side of the deleted portion of the first outer segment, and a portion of the second outer segment of the substrate defined as a deleted portion of the second outer segment such that a portion defined as a remaining portion of the second outer segment remains to interconnect portions of the second outer segment on each side of the deleted portion of the second outer segment wherein the deleted portions of the first and second outer segments are opposite and spaced from one another;

forming the substrate to provide a spacer stock having the base and the upright legs joined to the base, the base provided by the base segment of the substrate, the first upright leg provided by portions of the first outer segment of the substrate and the second upright leg provided by portions of the second outer segment of the substrate, with the first and second edges of the substrate spaced from one another, wherein the deleted portion of the first outer segment of the substrate is in the first upright leg of the spacer stock and the deleted portion of the second outer segment of the substrate is in the second upright leg of the spacer stock, and bending the base of the spacer stock at a location between the deleted portions of the first and second outer segments to move first and second remaining portions of the first and second outer segments toward the base to provide the spacer frame with the at least one corner, wherein the first upright leg of the spacer frame lies in a first plane, the second upright leg of the spacer frame lies in a second plane, the base of the spacer frame on one side of the at least one corner lies in a third plane and the base of the spacer frame on the other side of the at least one corner lies in a fourth plane, with the first and second planes parallel to one another, the third and fourth planes intersecting one another and the third and fourth planes intersecting the first and second planes and the base of the spacer frame and the first and second remaining portions of the first and second outer segments at the at least one corner being continuous.

25. The method as set forth in claim 24 wherein the first major surface of the substrate is inner surface of the spacer stock and further including the step of applying a moisture pervious adhesive having a desiccant therein on selected portions of the inner surface of the spacer stock.

26. The method as set forth in claim 24 wherein after the practice of the forming step providing a layer of a moisture impervious material on selected portions of the outer surface of the spacer frame.

27. The method as set forth in claim 24 further including the step of imposing a bend line on each side of the deleted portion of the first outer segment, the bend lines having a generally "V" shape configuration with the open end of the "V" facing the first edge of the substrate and a bend line on each side of the deleted portion of the second outer segment, the bend lines on each side of the deleted portion of the second outer segment having a generally "V" shape configuration with an open end of the "V" facing the second edge of the substrate and wherein the "V" formed by the bend lines in the first outer segment is in the first upright leg of the spacer stock and the "V" formed by the bend lines in the second outer segment is in the second upright leg of the spacer stock.

28. The method as set forth in claim 27 wherein the deleted portion of the first outer segment is a notch in the first edge of the substrate and the remaining portion of the first outer segment is between the notch in the first edge of the substrate and the base segment of the substrate, and the deleted portion of the second outer segment is a notch in the second edge of the substrate and the remaining portion of the second outer segment is between the notch in the second edge of the substrate and the base segment of the substrate.

29. The method as set forth in claim 28 wherein the spacer frame has four corners and further including repeating the removing and bending steps to provide three corners and including the step of joining ends of the spacer frame to form a closed spacer frame.

30. The method as set forth in claim 28 including the step of providing a bead of moisture and gas pervious material having a desiccant between the upright legs of the spacer stock.

31. The method as set forth in claim 30 wherein the substrate is a metal substrate.

32. The method as set forth in claim 31 wherein the second major surface of the substrate is an outer surface of the spacer stock and further including the step of providing a moisture and gas impervious sealant on the outer surfaces of the upright legs of the spacer stock.

33. The method of claim 19 further including the step of providing a moisture and gas impervious sealant on selected outer surfaces of the spacer stock.

34. The method of claim 33 wherein the selected outer surface of the spacer stock is outer surface of the upright legs of the spacer stock.

35. The method of claim 34 wherein the substrate is made of metal and the imposing step is practiced at three spaced positions on the substrate prior to the practice of the forming step.

36. The method of claim 16 wherein the imposing step is practiced at three spaced positions on the substrate prior to the practice of the shaping step.

37. The method as set forth in claim 22 further including the step of imposing a bend line on each side of the deleted portions of the first outer segment, the bend lines having a generally "V" shape configuration with an open end of the "V" facing the first edge of the substrate, and a bend line on each side of the deleted portion of the second outer segment with the open end of the "V" facing the first edge of the substrate wherein the "V" formed by the bend line in the first outer segment is in the first upright leg of the spacer stock and the "V" formed by the bend line imposed in the second outer segment is in the second upright leg of the spacer stock.

38. The method as set forth in claim 37 wherein the deleted portions of the first outer segment is a notch in the first edge of the substrate and the deleted portion of the second outer segment is a notch in the second edge of the substrate and the notch in the first outer segment is a notch in an edge of the first upright leg of the spacer stock and the notch in the second outer segment is a notch in an edge of the second upright leg of the spacer stock.

39. The method as set forth in claim 38 further including the step of applying a moisture pervious adhesive having a desiccant therein on selected portions of the first major surface of the substrate prior to the forming step.

40. The method as set forth in claim 39 wherein the second major surface of the substrate is an outer surface of the spacer stock and after the practice of said forming step providing a layer of a moisture impervious material on selected portions of the outer surface of the spacer stock.

41. The method of claim 40 wherein the imposing step is practiced at three spaced positions on the substrate prior to the practice of the shaping step.

42. The method as set forth in claim 41 wherein the substrate is made of metal.

43. The method of claim 22 wherein the imposing step is practiced at three spaced positions on the substrate prior to the practice of the forming step.

44. The method of claim 1 further including the step of pressing the portions of the upright legs over the base against portions of the inner surface of the adjacent one of the upright legs.

* * * * *

UNITED STATES PATENT AND TRADEMARK OFFICE

CERTIFICATE OF CORRECTION

PATENT NO. : 5,501,013
DATED : March 26, 1996
INVENTOR(S) : Stephen C. Misera, William R. Siskos and Thomas P. Kerr It is certified that error appears in the above-indentified patent and that said Letters Patent is hereby corrected as shown below:

Column 9, claim 22, line 3, after "as" insert --a--;

column 9, claim 22, line 4, after "that" insert --a--.

Column 11, claim 37, line 3, delete "portions" and insert --portion--.

Signed and Sealed this
Ninth Day of July, 1996

Bruce Lehman

*Attest:*

BRUCE LEHMAN

*Attesting Officer*

*Commissioner of Patents and Trademarks*